United States Patent [19]

Soneta et al.

[11] Patent Number: 4,555,389

[45] Date of Patent: Nov. 26, 1985

[54] METHOD OF AND APPARATUS FOR BURNING EXHAUST GASES CONTAINING GASEOUS SILANE

[75] Inventors: Eietsu Soneta, Kawasaki; Tetsukazu Urata, Iruma, both of Japan

[73] Assignee: Toyo Sanso Co., Ltd., Tokyo, Japan

[21] Appl. No.: 604,720

[22] Filed: Apr. 27, 1984

[51] Int. Cl.[4] ..... B01J 12/00; B01D 47/00; C01B 33/04

[52] U.S. Cl. ..... 423/210; 423/336; 423/337

[58] Field of Search ..... 423/210, 336, 337

[56] References Cited

U.S. PATENT DOCUMENTS 3,086,851 4/1963 Wagner ..... 423/336
3,954,945 5/1976 Lange et al. ..... 423/337

FOREIGN PATENT DOCUMENTS 21993 6/1973 Japan ..... 423/337

*Primary Examiner*—John Doll

*Assistant Examiner*—Robert Alway

*Attorney, Agent, or Firm*—Armstrong, Nikaido, Marmelstein & Kubovcik

[57] ABSTRACT

A method of burning exhaust gases containing gaseous silane in which the exhaust gases containing gaseous silane to be introduced into a combustion chamber are diluted with an inert gas so that the concentration of silane gas is reduced to less than 30% by volume and the diluted exhaust gases are fed from a nozzle to the combustion chamber and burnt through reaction with air in the combustion chamber while the region between the head of the nozzle top end and the base portion of the burning flame is shielded with an inert gas atmosphere.

An inert gas mixing pipe is connected for dilution to an exhaust gas feed section, an enclosure pipe is fitted to the outer circumference of an exhaust gas introduction pipe introduced into the combustion chamber to constitute a double pipe structure, and the enclosure pipe is connected at the rear end thereof to an inert gas feed pipe and slightly protuded at the top end thereof ahead of the top end for the exhaust gas introduction pipe.

5 Claims, 5 Drawing Figures

Concentration and Decomposition Rate of $SiH_4$ Gas after Combustion

Spontaneous flamability of $SiH_4/H_2$

Spontaneous flamability of $SiH_4/N_2$

METHOD OF AND APPARATUS FOR BURNING EXHAUST GASES CONTAINING GASEOUS SILANE

BACKGROUND OF THE INVENTION

This invention concerns a method of and an apparatus for burning waste gases containing gaseous silane or silane gas for use in the processing of such exhaust gases and, more specifically, it relates to a method of and an apparatus for burning exhaust gases containing gaseous silane wherein a barrier of an inert gas atmosphere is formed near the top end of an injection nozzle introduced to the inside of a combustion chamber, so that spontaneously flammable gases contained in the exhaust gases are burnt ahead of the inert gas atmosphere.

Exhaust gases containing a silane gas discharged from the reactor of a semiconductor manufacturing plant or the like are highly toxic and tend to ignite spontaneously upon contact with air. In one of the methods for processing exhaust gases of this type, the exhaust gases are diluted with nitrogen gas and then washed and decomposed in a scrubber, followed by discharging. However, this method involves various drawbacks in that the toxicity and the flammability of the gases can not completely be eliminated due to the insufficient decomposition of the gaseous silane in the exhaust gases or in that the decomposition products are accumulated within the scrubber.

In an alternative method, in view of the above, the exhaust gases are fed as they are to a combustion equipment, where the gaseous silane in the exhaust gases are oxidized and decomposed through the combustion reaction with air in the combustion equipment and, then, they are washed in the scrubber. In this method, however, when the gaseous silane contained in the exhaust gases discharged from an exhaust gas nozzle are brought into the combustion reaction with the air in the combustion equipment, oxides, particularly, silicon oxides are formed through the combustion and deposited at the top of the nozzle and gradually grow thereon to narrow the inside of the nozzle. This hinders the complete burning of the gaseous silane and, as the result, the exhaust gases are discharged as they are while possessing the toxicity and the flammability. Furthermore, if the silicon oxides deposited on the top end of the nozzle further grow, the bore of the nozzle is clogged, thereby causing the pressure increase within the exhaust gas pipe. Then, when the pressure inside the pipe reaches a certain high level, the mass of the silicon oxides blocking the inside of the nozzle is scraped off by the pressure, and the exhaust gases are rapidly discharged in a great volume, which results in the extremely dangerous explosive burning in the combustion chamber.

In addition, since the mass of the silicon oxides thus formed is relatively large, it gradually deposits within the combustion chamber and requires much labour for the maintenance of the combustion equipment.

SUMMARY OF THE INVENTION

An object of this invention is to provide a method of and apparatus for burning exhaust gases containing gaseous silane capable of eliminating the possibility that the combustion products of exhaust gases are deposited at the top end of an exhaust gas nozzle, and avoiding the accumulation of combustion products in the combustion chamber in the course of processing such exhaust gases.

Another object of this invention is to provide a combustion apparatus capable of rectifying the flow of air fed to the combustion chamber and preventing the backfire to an air feed section.

A still further object of this invention is to provide a burning apparatus capable of controlling the flow rate of exhaust gases and inert gases fed to the combustion chamber.

BRIEF DESCRIPTION OF THE DRAWINGS

These and other objects, as well as the features of this invention will be made clearer by the following descriptions referring to the accompanying drawings, wherein.

DETAILED DESCRIPTION OF THE INVENTION

Heretofore, oxidation and decomposition of exhaust gases containing gaseous silane in a combustion chamber followed by washing of the combustion products in a scrubber have generally been carried out based on the general technical concept of feed exhaust gases containing gaseous silane discharged out of a reactor as they are from the top end of an exhaust gas nozzle in a single tube structure to the combustion chamber by the pressure of the gases per se or by using a vacuum pump, reacting the exhaust gases with air fed to the chamber and burning the gaseous silane in the exhaust gases through spontaneous ignition.

Figure 4:
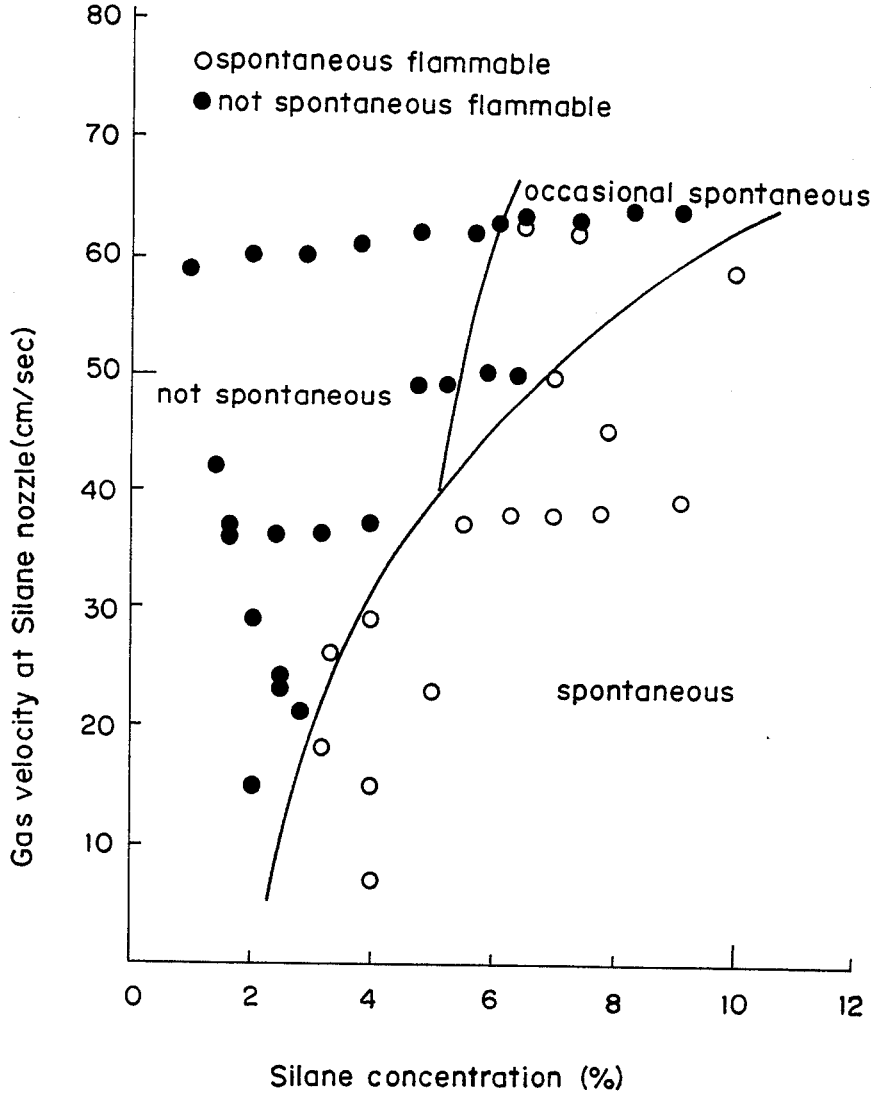
FIGS. 4 and 5 are graphs showing the relationship between the flow velocity of exhaust gases diluted with inert gases and the concentration of gaseous silane in the exhaust gases with respect to the spontaneous flammability of the gaseous silane.
Figure 5:
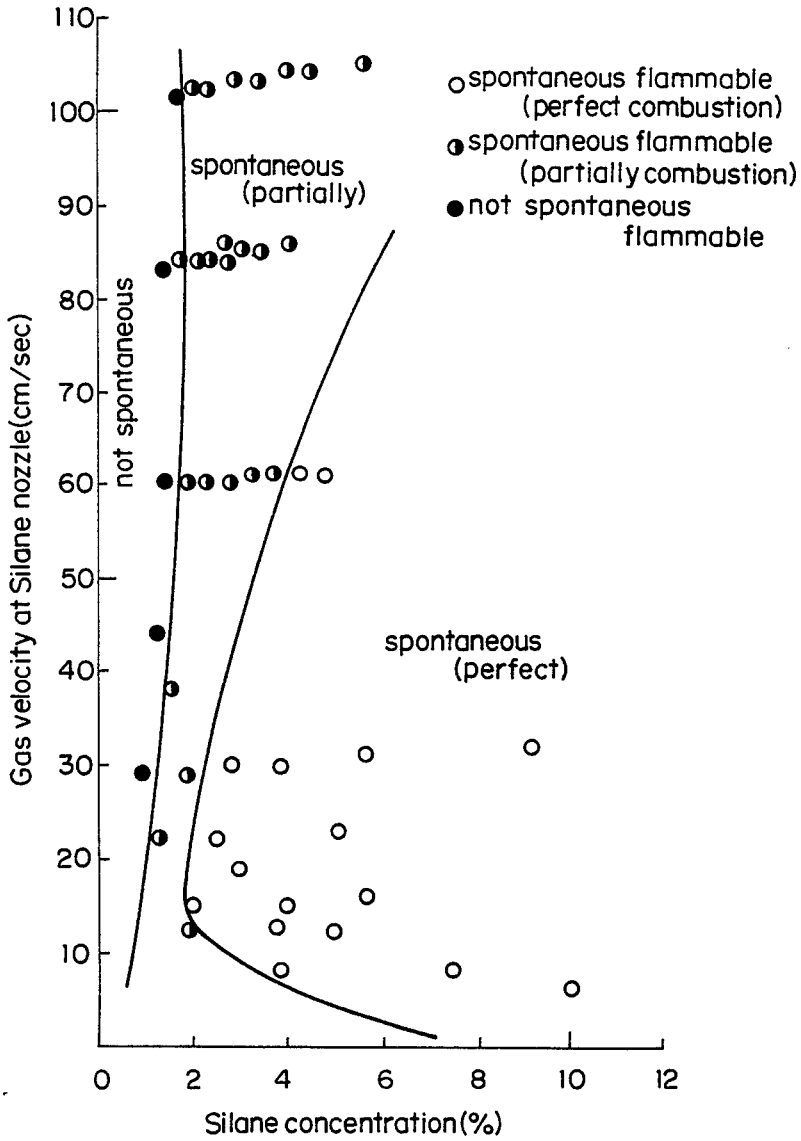

By the way, if the concentration or density of the gaseous silane contained in the exhaust gases is relatively high, fine particles and oxides contained in the exhaust gases coagulate to each other into a fiberous state, which is difficult to be discharged outside of the combustion chamber. While on the other hand, it has also been confirmed in the experiment carried out by the present inventors that exhaust gases diluted, for example, with nitrogen gas or hydrogen gas still possess the spontaneous flammability in airs at a gaseous silane concentration as low as 1.5–4% (by volume here and hereinafter) as shown in FIGS. 4 and 5 of the drawings.

Taking notice of the foregoing facts, in the method according to this invention, exhaust gases containing gaseous silane fed to a combustion chamber are diluted with nitrogen or like other inert gas so that the concentration of the gaseous silane contained therein is lowered to less than 30% as a pre-treatment for the combustion of the exhaust gases. The exhaust gases diluted in this way are subjected to combustion due to the spontaneous ignition with air in the combustion chamber. As described above, since the exhaust gas nozzle of a single tube structure is in direct contact with the air in the combustion chamber in the conventional method, the gaseous silane in the exhaust gases is instantly brought into reaction with air and burnt at the top end of the nozzle, which result in the deposition of the combustion products (silicon oxides) at the top end of the nozzle. In order to overcome such disadvantages, a gas barrier of an inert gas atmosphere such as nitrogen gas or the like is formed near the top end of the exhaust gas nozzle in the method according to this invention. More specifically, since the barrier of the inert gas atmosphere is formed at the top end of the exhaust gas nozzle, the silane gas or like other spontaneously flammable gas contained in the exhaust gases is not burnt in the inert gas atmosphere near the top end of the nozzle but burnt at the downstream thereof in contact with the air after passing over the inert gas atmosphere.

In accordance with the burning method of this invention as described above, exhaust gases discharged from a reactor are diluted with an inert gas so that the concentration of the gaseous silane contained in the exhaust gases may be reduced to less than 30% and then fed by way of an exhaust gas introduction pipe to a combustion chamber, where an inert gas atmosphere is formed within the combustion chamber near the top end of the exhaust gas nozzle or pipe. As the result, there is produced no coagulation of fine particles and oxides in the combustion chamber which would otherwise be caused due to the gaseous silane at high concentration. Further, since a gap is provided between the top end of the exhaust gas nozzle and the burning flame by way of the inert gas atmosphere, there is no possibility that oxides, e.g., silicon oxides as combustion products are deposited at the top end of the nozzle. This is very much useful for continuing the preferred satisfactory combustion state of the exhaust gases smoothly, and for effectively preventing the accumulation of the combustion products in the combustion chamber.

Explanation will now be made to a burning apparatus suitable to the practice of the method according to this invention.

The burning apparatus according to this invention basically comprises:

a combustion chamber having an exhaust port leading to a scrubber, an air feed section in communication with the combustion chamber by way of vent holes, an exhaust gas feed section in which a pipe from an inert gas mixing pipe is connected to a receiving part for exhaust gases containing the gaseous silane discharged out of a reactor, an exhaust gas introduction pipe the top end nozzle of which is opened to the inside of the combustion chamber and the rear end of which is in communication with the exhaust gas feed section, an enclosure pipe fitted around the outer circumference of the exhaust gas introduction pipe with a radial gap therebetween while the open top end thereof being protruded ahead of the nozzle top end of the exhaust gas introduction pipe, and an inert gas feed section connected to the rear end of the enclosure pipe.

The apparatus according to this invention will be explained more in detail referring to preferred embodiments.

Figure 1:
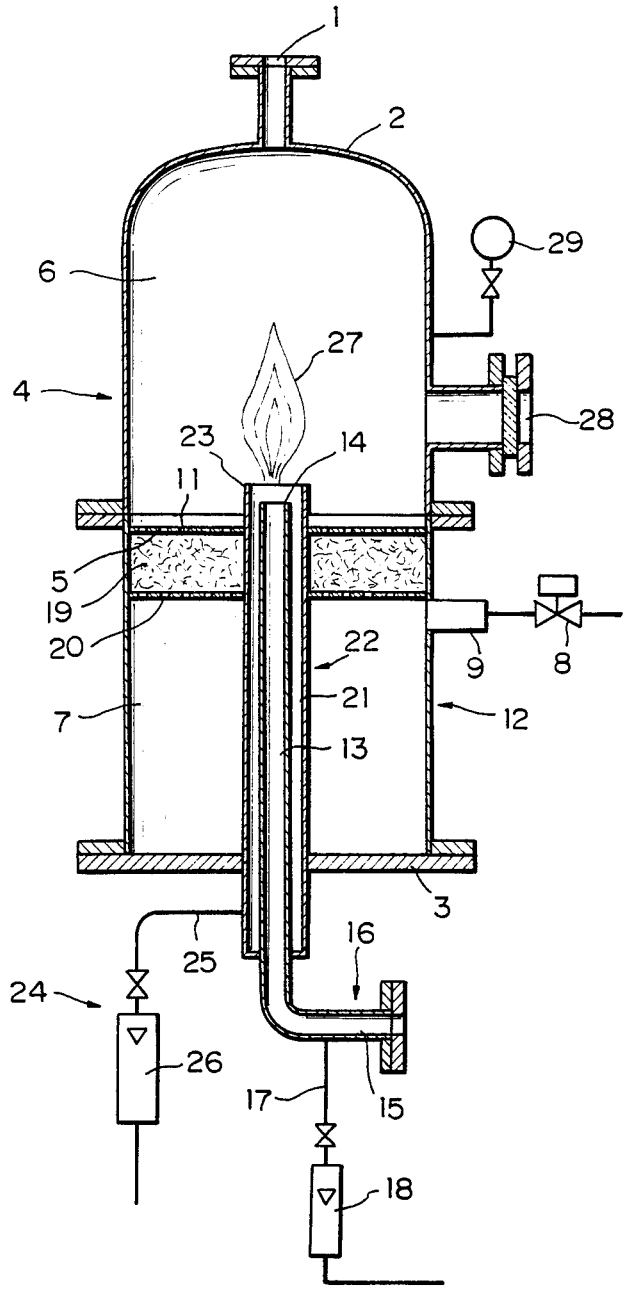
FIG. 1 is a vertical cross sectional view of a burning apparatus as a preferred embodiment according to this invention.

As shown in FIG. 1, a vertical cylindrical body 4 is closed at the top end thereof with an upper plate 2 having an exhaust port 1 and closed at the lower end thereof with a lower plate 3. The cylindrical body 4 is divided into upper and lower sections at an intermediate position thereof with a perforated plate 5, in which the upper section defines a combustion chamber 6 and the lower section defines an air chamber 7. The air chamber 7 has an air feed pipe 9 connected thereto and attached with a solenoid valve 8 connected thereto. The air chamber 7 thus formed below the combustion chamber 6 is in communication with the chamber 6 by way of vent holes 11 in the perforated plate 5 to constitute an air feed section 12 to the combustion chamber 6.

An exhaust gas introduction pipe 13 is inserted axially into the cylindrical body 4 from below the air chamber 7 while passing through the lower plate 3 and the perforated plate 5, and the pipe 13 is disposed such that the top end nozzle 14 thereof is protruded into the combustion chamber 6.

The exhaust gas introduction pipe 13 is connected to the exhaust gas feed section 16 receiving the exhaust gas containing the gaseous silane, by being connected at the rear end of the pipe with an exhaust gas pipe 15 from a reactor (not shown) that discharges exhaust gases containing gaseous silane. In this way, in the embodiment shown in FIG. 1, the exhaust gas feed section 16 comprises the pipe 15 for feeding the exhaust gases from the reactor and the pipe is in direct connection with the exhaust gas introduction pipe 13.

Furthermore, an inert gas mixing or feed pipe 17 is connected to the exhaust gas feed section 16 so that an inert gas may be mixed into the exhaust gases in the exhaust gas feed section 16 to dilute the concentration of the gaseous silane in the exhaust gases. A flow rate regulator 18 is disposed to the inert gas mixing or feed pipe 17 so as to control the flow rate and the flow velocity of the exhaust gases jetted out from the top end nozzle of the exhaust gas introduction pipe 13.

In a case if the boundary between the combustion chamber 6 and the air chamber 7 is merely composed of the perforated plate 5, flow of air from the air chamber 7 to the combustion chamber 6 localizes to specific positions of the plate 5, Also if the boundry is merely composed of the perforated plate 5, the flame in the combustion chamber 6 may intrude into the air chamber 7 to cause so-called backfire. In view of the above, it is desired that an air permeable and non-combustible porous filler material layer 19 is formed in an adequate thickness to the lower surface of the perforated plate 5. In the case of using granular filler material, a support material 20 in the form of a metal gauge or lattice is fitted to the bottom of the filler material layer 19 so that the filler material may not fall through.

An enclosure pipe 21 is inserted in the same manner as the exhaust gas introduction pipe 13 while passing through the lower plate 3 of the air chamber 7 and the perforated plate 5, and the pipe 21 is disposed around the outer circumference of the exhaust gas introduction pipe 13 substantially coaxial therewith with an appropriate radial gap to constitute a double pipe structure. The open top end 23 of the enclosure pipe 21 is disposed so as to be protruded ahead of the top end nozzle of the exhaust gas introduction pipe 13 preferably by about 2–10 mm. The rear end of the enclosure pipe 21 is connected to an inert gas feed section 24. In the embodiment shown in FIG. 1, the inert gas feed section 24 comprises a pipe 25 in communication with an inert gas supply source. A flow rate regulator 26 for the inert gas is disposed to the pipe 25, so that the flow rate and the flow velocity of the inert gas jetted out of the top end nozzle of the enclosure pipe 21 may be adjusted properly.

A view window 28 is provided to the combustion chamber 6 so that the state of the inside, particularly, the state of the flames 27 produced above the nozzle of the exhaust gas introduction pipe 13 and the enclosure pipe 21 can be monitored. A pressure gauge 29 is disposed to the combustion chamber 6 and, if desired, also to the exhaust gas feed section 16.

While the explanation has been made to the embodiment shown in FIG. 1, in which one combustion nozzle 22 of a double pipe structure comprising the exhaust gas introduction pipe 13 and the enclosure pipe 21 is used, such a nozzle of the double pipe structure may be arranged in plurality.

Figure 2:
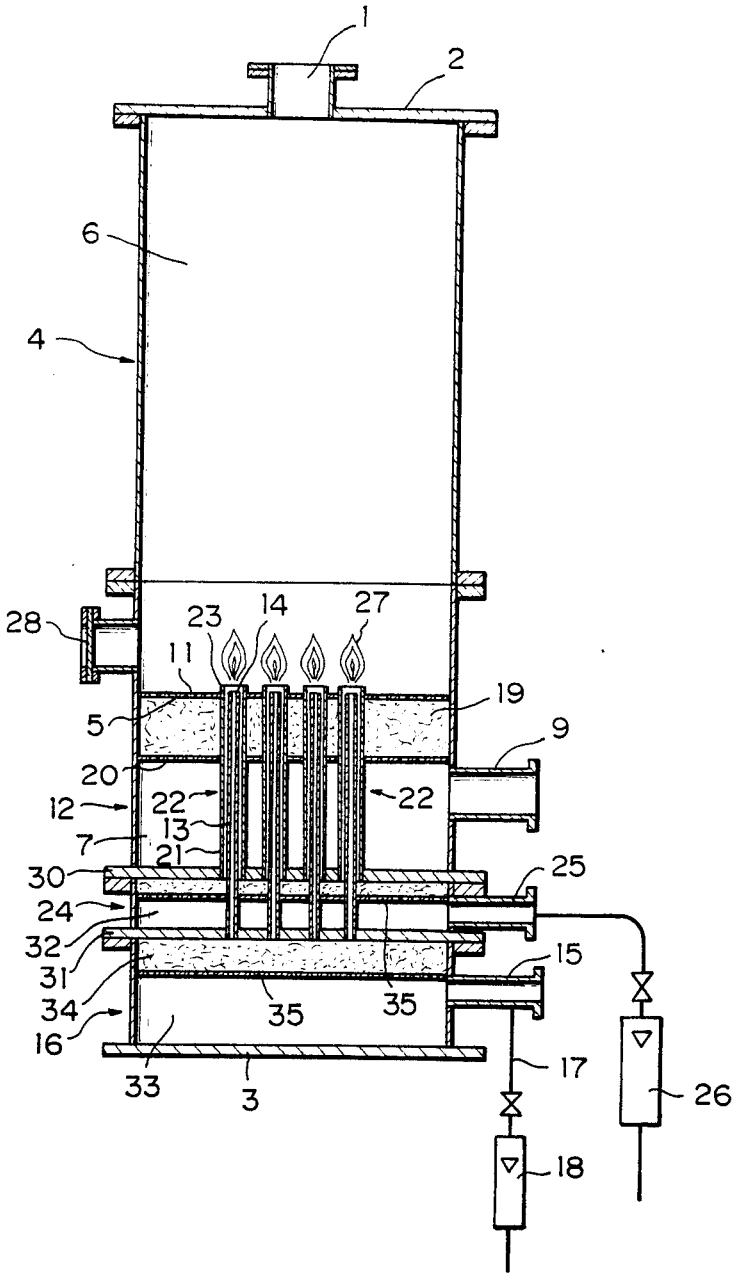
FIG. 2 is a vertical cross sectional view of a burning apparatus as another embodiment according to this invention.

FIG. 2 illustrates another preferred embodiment according to this invention which is particularly suitable to the case where a plurality of double pipe nozzles 22 are used. In FIG. 2, the components or parts substantially the same as those in FIG. 1 carry the same reference numerals.

As shown in FIG. 2, the rear ends of a plurality of exhaust gas introduction pipes 13 are connected in common to an exhaust gas feed section 16 and the rear ends of a plurality of enclosure pipes 21 are connected in common to an inert gas feed section 24 respectively. In order to attain such a structure, a cylindrical body 4 closed at the upper and the lower ends with an upper plate 2 having an exhaust port 1 and a lower plate 3 respectively is partitioned at the intermediate position thereof with a perforated plate 5, in which the upper section constitutes a combustion chamber 6. The inside of the cylindrical body below the perforated plate 5 is further divided by two upper and lower partition plates 30, 31 into three sub-chambers in adjacent with each other in the vertical direction, in which the uppermost part constitutes an air chamber 7, an intermediate part constitutes an inert gas chamber 32 and the lowermost part constitutes an exhaust gas chamber 33 respectively. As shown in FIG. 2, the air feed section 12 is substantially in the same structure as that of the embodiment shown in FIG. 1. While on the other hand, the inert gas feed section 24 comprises the inert gas chamber 32 connected with an inert gas pipe 25 and the exhaust gas feed section 16 comprises the exhaust gas chamber 33 connected with a pipe for feeding the exhaust gases from the reactor and an inert gas feed pipe 17. A plurality of exhaust gas introduction pipes 13 are secured at each rear end thereof to the lower partition plate 31, being in communication with the exhaust gas chamber 33 and with the combustion chamber 6, while being slightly protruded into the chamber 6 after passing through the upper partition plate 30 and the perforated plate 5. While on the other hand, a plurality of enclosure pipes 21 are coaxially arranged each with a radial gap around the outer circumference of the exhaust gas introduction pipes 13 respectively. The rear ends of the enclosure pipes 21 are respectively secured to the upper partition plate 30, being in communication with the inert gas chamber 32 and the open top ends 23 of the enclosure pipe 21 are respectively protruded slightly from above the top end nozzles 14 of the exhaust gas introduction pipes 13 preferably by 2–10 mm after passing through the perforated plate 5. Desirably, a filler material layer 19 and a support material 20 similar to those in the previous embodiment in FIG. 1 are disposed to the bottom of the perforated plate 5, as well as a rectifying layer 34 comprising porous filler material capable of permeating the passage of the gas in the inert gas chamber 33 or the gas in the exhaust gas chamber 32 and a support material 35 therefor are disposed to the bottom of the lower partition plate 31 which forms the top plate for the inert gas chamber 33 and to the bottom of the lower partition plate 31 which forms the top plate for the exhaust gas chamber 32, so that gases in each of the chambers are uniformly fed to the combustion chamber.

Furthermore, in the same manner as in the embodiment shown in FIG. 1, flow rate regulators 26, 18 are desirably disposed to the inert gas feed pipe 17 of the exhaust gas feed section 16 and the inlet feed pipe 25 of the inert gas feed section 24.

Although not illustrated in the drawing, pressure gauges may desirably be provided to the exhaust gas chamber 33 and the combustion chamber 6, and a speed meter may also be disposed to the combustion chamber.

In the structure as described above, the exhaust gases containing the gaseous silane discharged from the reactor is diluted with the admixing of the inert gas in the exhaust gas feed section 16 to reduce the concentration of the gaseous silane. Then, the diluted exhaust gases are fed by way of the exhaust gas introduction pipe 13 to the combustion chamber 6, where the flammable gases such as gaseous silane in the exhaust gases are brought into reaction with the air in the combustion chamber 6 and burnt out. In this case, since the inert gas fed through the enclosure pipe 21 disposed at the outer circumference of the exhaust gas introduction pipe 13 forms a barrier of the inert gas atmosphere near the nozzle top end 14, the flammable gas in the exhaust gases is burnt above the barrier of the inert gas atmosphere. Consequently, since a gap is formed between the top end of the exhaust gas introduction pipe 13 that forms the combustion pipe nozzle 22 and the flame 27, oxides, e.g., silicon oxides formed through the combustion do not deposit on the nozzle 14 but are discharged in the form of fine powder through the exhaust port 1 together with exhaust gases. Accordingly, narrowing or blocking of the nozzle 14 can be prevented and the accumulation of the combustion products to the inside of the combustion chamber 6 can be avoided. Furthermore, since the concentration of the gaseous silane in the exhaust gases is previously diluted to less than about 30%, undesired coagulation of oxides into the fiberous state in the gas stream can be prevented. Furthermore, the provision of the filler material layer can rectify the gas stream and prevent the backfire. In addition, according to this invention, gaseous diborane, arsine, phophine, dichlorosilane or the like also contained in the exhaust gases can be decomposed through combustion in the same manner as the gaseous silane. Example Using the burning apparatus as shown in FIG. 1, silane gas was burnt according to the method of this invention.

The outer diameter and the bore diameter were set to 30 mm and 26 mm respectively for the outer pipe (enclosure pipe) and the 21.7 mm and 19 mm respectively for the inner pipe (exhaust gas introduction pipe). At the top end of the double-pipe nozzle, the outer pipe was protruded by 2 mm ahead of the inner pipe. Combustion air was fed at a flow rate of 550 l/min, while silane gas was fed at a flow rate of 1–20 l/min to the combustion chamber after being diluted to 1–40% concentration by nitrogen gas or hydrogen gas.

Test 1

Silane gas was fed at a flow rate of 10 l/min after being diluted to 10% concentration by nitrogen gas, while another stream of nitrogen gas was passed as an inert gas through the outer pipe at a flow rate of 1 l/min for protecting the inner pipe. No cloggings were observed at all even after the elapse of 100 hours.

As a comparison, diluted silane gas was burnt under the same conditions as above, excepting that no inert gas was fed to the outer pipe for the protection of the inner pipe. Deposits were instantly observed at the inner pipe and bore of the the outer pipe was almost clogged after 15 min from the start of the burning.

Test 2

When the silane gas was fed under the same conditions as described in Test 1 after being diluted with nitrogen gas to 20% concentration, powderous matters produced were in a finely atomized state and all of them were discharged entrained by the gas stream out of the exhaust port.

While on the other hand, in the case of increasing the concentration of the silane gas to 40%, the powderous matters were coagulated into a fiberous state and suspended within the combustion chamber. Further, bulky fiberous matter were stagnated in a fluidized state on the perforated plate.

Test 3

Gaseous arsine, diborane and phosphine were added by 1500 ppm to a gas containing silane gas diluted to 10% concentration of hydrogen gas and the mixed gas was burnt in the same manner as in the previous tests. It was found that all of the gases added were completely decomposed at the exit of the burning apparatus.

Test 4

Silane gas was burnt by the method according to this invention and the oxidative decomposition ratio of silane through combustion was measured. The result was compared with that obtained by the conventional method of burning the silane gas above the water surface after once passing through the water. It was found that the silane gas was completely decomposed to a lower concentration through combustion by the method according to this invention.

Figure 3:
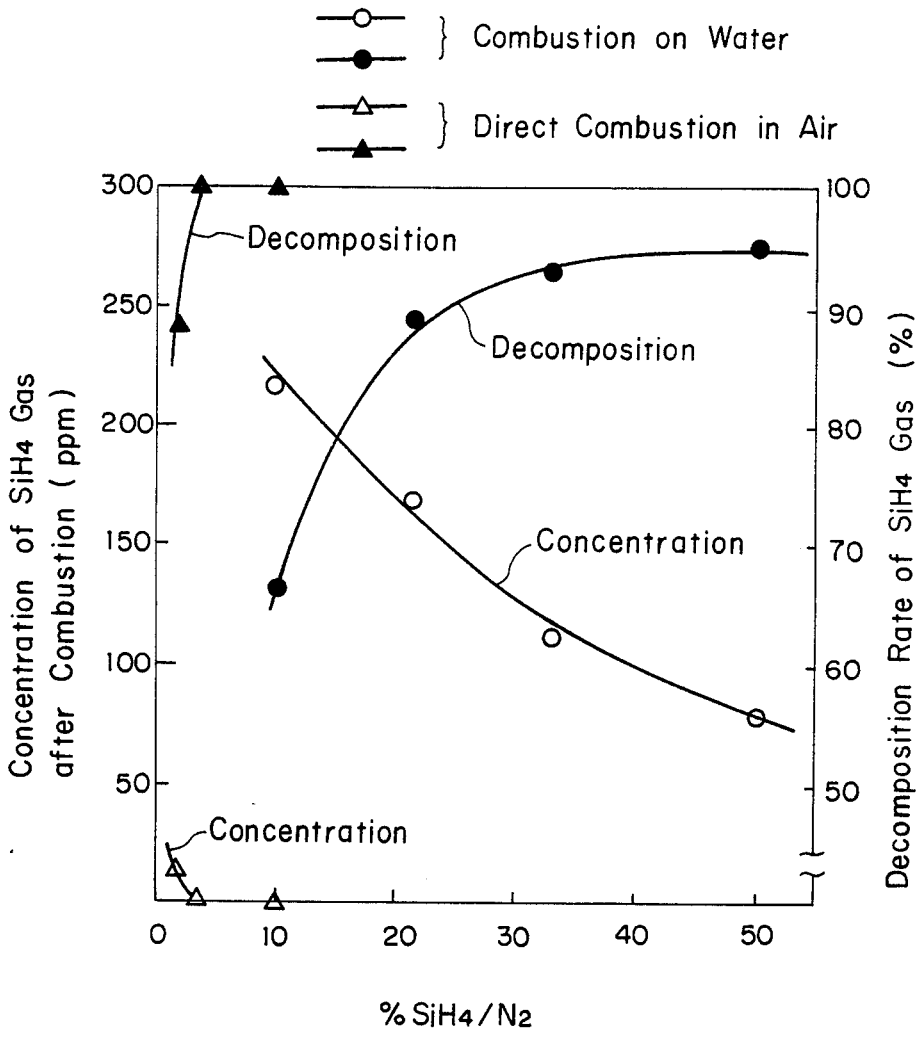
FIG. 3 is a graph showing the concentration and the decomposition rate of gaseous silane after combustion.

The combustion curve for $SiH_4/H_2$ was plotted as shown in FIG. 3.

Test 5

The combustion test was carried out by using the apparatus as shown in FIG. 1, in which 16 sets of double-pipe nozzles each comprising the inner pipe and the outer pipe of the same structure and the size as described previously were mounted.

The filler material layer and the rectifying layer were attached to each of the exhaust gas chamber, the inert gas chamber and the air chamber respectively as shown in FIG. 2 and silane gas diluted to 10% concentration by volume with nitrogen was fed to the combustion chamber. It was found that backfire was caused neither to the inside of the combustion nozzle nor to the air chamber even if the gas was fed at a flow rate of 500 l/min. While on the other hand, in the case where the filler material layers were removed in the same apparatus as above, the backfire was caused intermittently, if the diluted silane gas was fed at a flow rate greater than 120 l/min to the combustion chamber.

What is claimed is:

1. A method of burning exhaust gases containing gaseous silane in the course of processing the exhaust gases containing the gaseous silane by burning the gases through the reaction with air in a combustion chamber, which comprises:
   - a step of previously diluting the exhaust gases to be introduced into the combustion chamber with an inert gas so that the concentration of the gaseous silane contained in the exhaust gases is reduced to less than 30% by volume,
   - a step of feeding the thus diluted exhaust gases from the nozzle of an exhaust gas introduction pipe to the combustion chamber, and
   - a step of feeding an inert gas to the vicinity of the nozzle top end of the exhaust gas introduction pipe to form a barrier of the inert gas atmosphere thereby contacting the diluted exhaust gases introduced into the combustion chamber with the air ahead of the barrier of the inert gas atmosphere.

2. The method of claim 1 which further comprises that the exhaust gases containing silane be discharged from a reactor producing waste gases which contain silane.

3. The method of claim 1 which further comprises that burning products produced by the reaction in the combustion chamber be treated in a scrubber.

4. The method of claim 2 which further comprises that burning products produced by the reaction in the combustion chamber be treated in a scrubber.

5. An improved method of processing exhaust gases containing gaseous silane wherein exhaust gases which are discharged from a reactor are burned through a reaction with air in a combustion chamber and then the burning products are treated in a scrubber, the improvement which comprises:
   - a step of previously diluting the exhaust gases to be introduced into the combustion chamber with an inert gas so that the concentration of the gaseous silane contained in the exhaust gases is reduced to less than 30% by volume,
   - a step of feeding the thus diluted exhaust gases from the nozzle of an exhaust gas introduction pipe to the combustion chamber, and
   - a step of feeding an inert gas to the vicinity of the nozzle top end of the exhaust gas introduction pipe to form a barrier of the inert gas atmosphere thereby contacting the diluted exhaust gases introduced into the combustion chamber with the air ahead of the barrier of the inert gas atmosphere.

* * * * *